US006882251B2

(12) United States Patent
Yu et al.

(10) Patent No.: US 6,882,251 B2
(45) Date of Patent: Apr. 19, 2005

(54) MICROWAVE FILTER WITH ADAPTIVE PREDISTORTION

(75) Inventors: Ming Yu, Waterloo (CA); Van Dokas, Cambridge (CA); Wai-Cheung Tang, Mannheim (CA)

(73) Assignee: Com Dev Ltd., Cambridge (CA)

( * ) Notice: Subject to any disclaimer, the term of this patent is extended or adjusted under 35 U.S.C. 154(b) by 116 days.

(21) Appl. No.: 10/314,352

(22) Filed: Dec. 9, 2002

(65) Prior Publication Data

US 2004/0108920 A1 Jun. 10, 2004

(51) Int. Cl.[7] ..... H01P 1/20
(52) U.S. Cl. ..... 333/202; 333/206
(58) Field of Search ..... 333/202, 203, 333/204, 205, 206, 207, 208, 209, 221, 223, 231

(56) References Cited

U.S. PATENT DOCUMENTS

| | | | | |
|---|---|---|---|---|
| 4,847,864 A | | 7/1989 | Cupo | |
| 4,881,051 A | * | 11/1989 | Tang et al. | 333/208 |
| 5,254,963 A | | 10/1993 | Bonetti et al. | |
| 5,608,363 A | | 3/1997 | Cameron et al. | |
| 5,739,733 A | * | 4/1998 | Cameron | 333/202 |
| 5,760,667 A | | 6/1998 | Young et al. | |
| 5,812,036 A | | 9/1998 | Estrada | |
| 6,096,090 A | | 8/2000 | Guglielmi et al. | |

OTHER PUBLICATIONS

Riccardo Tascone et al., Mar. 2000, IEEE Transactions on Microwave Theory, vol. 48, No. 3, 423–429.*

Tascone et al.; "Scattering Matrix Approach for the Design of Microwave Filters", IEEE Transactions on Microwave Theory and Techniques; vol. 8, No. 43, Mar. 2000.

Yu et al.; "Novel Adaptive Predistortion Technique for Cross Coupled Filters"; 2003 IEEE MTT–S International Microwave Symposium Digest; vol. 3 of 3, Jun. 8, 2003.

Williams et al.; "Predistortion Techniques for Multicoupled Resonator Filters" IEEE Transactions on Microwave Theory and Techniques; vol. 3, No. 5, May 1985.

A. Atia and A Williams, New Type of waveguide bandpass filters for satellite transponders, COMSAT Tech Rev., vol. 1, No. 1, pp. 21–43, 1971.

John W. Bandler, Shao Hua Chen, and Shahrokh Daijavad, Microwave Device Modeling Using Efficient L1 Optimization: A Novel Approach, IEEE Transactions On Microwave Theory and Techniques, vol. MTT–34, No. 12, Dec. 1988, pp. 1282–1293.

R.J. Cameron, General Prototype Network–Synthesis Methods for Microwave Filters, ESA Journal 1982, vol. 6, pp. 193–206.

Chandra Kudsia, Richard Cameron, and Wai–Cheung Tang, Innovations in Microwave Filters and Multiplexing Networks for Communications Satellite Systems, IEEE Transactions On Microwave Theory and Techniques, vol. 40, No. 6, Jun. 1992, pp. 1133–1149.

Robert M. Livingston, Predistorted Waveguide Filters For Use In Communications Systems, G–MTT Int. Microwave Symp., Dig. 1969, pp. 291–297.

A.E. Williams, W.G. Bush, and R.R. Bonetti, Predistortion Techniques For Multicoupled Resonator Filters, IEEE Transactions On Microwave Theory and Techniques, vol. MTT–33, No. 5, May 1985, pp. 402–407.

J. Uher, J. Bornemann and U. Rosenberg, Waveguide Components for Antenna Feed Systems: Theory and CAD, Artech House, Boston–London, 1993, pp. 174–252.

* cited by examiner

*Primary Examiner*—Robert Pascal
*Assistant Examiner*—Dean Takaoka
(74) *Attorney, Agent, or Firm*—Bereskin & Parr

(57) ABSTRACT

The invention provides a method and apparatus for a adaptively predistorted filter which has a transfer function that satisfies performance criteria specified for at (east one property of the filter. The transfer function is obtained by adaptively predistorting the transfer function poles to meet the performance criteria such that at least one of the poles is shifted by a unique amount.

26 Claims, 10 Drawing Sheets

MICROWAVE FILTER WITH ADAPTIVE PREDISTORTION

FIELD OF THE INVENTION

The invention relates to filters and more particularly to a method and apparatus for realizing a transfer function for a filter based on adaptive predistortion.

BACKGROUND OF THE INVENTION

A microwave filter is an electromagnetic circuit that can be tuned to pass energy at a specified resonant frequency. Accordingly, microwave filters are commonly used in telecommunication applications to transmit energy in a desired band of frequencies (i.e. the passband) and reject energy at unwanted frequencies (i.e. the stopband) that are outside of the desired band. In addition, the microwave filter should preferably meet some performance criteria for properties which typically include insertion loss (i.e. the minimum loss in the passband), loss variation (i.e. the flatness of the insertion loss in the passband), rejection or isolation (the attenuation in the stopband), group delay (i.e. related to the phase characteristics of the filter) and return loss.

In order to design a microwave filter to meet the above-mentioned performance criteria, it is well known in the art to vary the shape of the transfer function of the microwave filter. The transfer function (H(s)) of the microwave filter can be defined by a polynomial according to equation 1 shown below.

$$H(s) = \frac{D(s)}{E(s)} \tag{1}$$

where D(s) and E(s) are polynomials of the variable s, $s=j\omega$, $j=\sqrt{-1}$ and $\omega$ is angular frequency. The roots of the numerator polynomial D(s) are known as transmission zeros of the filter and the roots of the denominator polynomial E(s) are known as poles of the filter. The shape of the transfer function (H(s)) can be changed to meet the performance criteria by varying the number of transmission zeros and poles and using different filter types such as Chebychev, elliptical, Butterworth, etc. to obtain different placements for the locations of these transmission zeros and poles.

By varying the number of poles (i.e. the order of the filter), the physical characteristics of the microwave filter such as the size and shape will change. In addition to varying the number of poles, the shape, size, quality and conductivity of the internal resonators of the filter may also be changed. As is well known to those skilled in the art, a resonator may be a hollow metallic chamber with precise dimensions. The chamber, also referred to as a cavity, usually incorporates relatively small apertures (i.e. irises) to couple energy between at least one other chamber. Alternatively, resonators may be in the form of a cavity having a metallic post or ceramic dielectric material. The dimensions of the resonators are determined by the use of design and synthesis tools as is well known to those skilled in the art.

When the material type and the size of the resonators for the filter are chosen, the Q (i.e. quality) factor for the filter is set. The Q factor has a direct effect on the amount of insertion loss and pass-band flatness of the realized microwave filter. In particular, a filter having a higher Q factor will have lower insertion loss and sharper slopes (i.e. a more "square" filter shape) in the transition region between the passband and the stopband. In contrast, filters which have a low Q factor have a larger amount of energy dissipation due to larger insertion loss and will also exhibit a larger degradation in band edge sharpness. Examples of high Q factor filters include waveguide and dielectric resonator filters which have Q factors on the order of 8,000 to 15,000. An example of a low Q factor filter is a coaxial resonator filter which typically has a Q factor on the order of 2,000 to 5,000.

As is conventionally known, in order to increase the Q factor of the filter, and hence the performance of the filter, the size of the resonators must be increased which results in a larger and heavier filter. This is disadvantageous since multi-cavity microwave filters are typically used in various space craft communication systems such as communication satellites in which there are stringent restrictions on payload mass.

Another issue with microwave filter design is that the transfer function of a microwave filter represents an ideal filter with an infinite Q factor. Since a microwave filter cannot be realized (i.e. constructed) with an infinite Q factor, but rather with resonators having a finite Q factor, the performance of a realized microwave filter is not the same as the ideal filter. Accordingly, the transfer function of the realized microwave filter will have passband edges that slump downward which causes distortion and intermodulation. There is also degradation in the loss variation in the passband of the realized filter.

In order to improve the loss variation and band edge sharpness of a realized microwave filter, an approach using predistortion was proposed by Livingston (Livingston, R. M., "Predistorted Waveguide filters", G-MTT Int. Microwave Symp., Dig. 1969, pp 291–297) and Williams et al. (Williams, A. E., Bush, W. G. and Bonetti R. R., "Predistortion Technique for Multicoupled Resonator Filters", IEEE Transactions on Microwave Theory and Techniques, Vol. MTT-33, No. 5, May 1985, pp 402–407). Livingston and Williams taught that predistortion of the poles could be used to correct for the effects of energy dissipation in the realized microwave filter to make the response of the realized filter approach that of an ideal filter. In particular, Livingston and Williams applied predistortion to the poles of a microwave filter having a high Q factor of 8,000. The poles of the filter transfer function were each predistorted by shifting the real part of the poles towards the jw axis by a similar amount before the filter was realized. The result was that the loss variation and band-edge sharpness of the realized predistorted filter were improved. However, the insertion loss and return loss degradation of the realized predistorted filter were severe to the point that the realized predistorted filter could not be used in a practical application. Furthermore, the realized predistorted filter had an undesirable increase in group delay ripple because the predistorted method did not consider group delay compensation.

SUMMARY OF THE INVENTION

In one aspect, the present invention provides a method for creating an adaptively predistorted filter, the method comprising:

a) designing a transfer function according to performance criteria specified for at least one property of the adaptively predistorted filter;

b) calculating the poles of the transfer function;

c) performing at least one iteration of adaptively predistorting the poles of the transfer function by shifting the poles, wherein at least one of the poles is shifted by a unique amount, relative to the shifting of the remaining poles, to obtain adaptively predistorted poles for creating an adaptively predistorted transfer function for achieving the performance criteria; and, d) realizing the adaptively predistorted filter accordingly to the adaptively predistorted transfer function.

In another aspect, the present invention provides an adaptively predistorted filter produced by:

a) designing a transfer function according to performance criteria specified for at least one property of the adaptively predistorted filter;

b) calculating the poles of the transfer function;

c) performing at least one iteration of adaptively predistorting the poles of the transfer function by shifting the poles, wherein at least one of the poles is shifted by a unique amount, relative to the shifting of the remaining poles, to obtain adaptively predistorted poles for creating an adaptively predistorted transfer function for achieving the performance criteria; and, d) realizing the adaptively predistorted filter accordingly to the adaptively predistorted transfer function.

In yet another aspect, the present invention provides an adaptively predistorted filter, the filter having an initial transfer function comprising a plurality of poles at initial locations, wherein the poles are adaptively predistorted for allowing the adaptively predistorted filter to achieve specified performance criteria, the poles being adaptively predistorted by shifting the poles away from the initial locations, at least one of the poles being shifted by a unique amount relative to the shifting of the remaining poles.

BRIEF DESCRIPTION OF THE DRAWINGS

For a better understanding of the present invention and to show more clearly how it may be carried into effect, reference will now be made, by way of example only, to the accompanying drawings which show a preferred embodiment of the present invention and in which.

DETAILED DESCRIPTION OF THE INVENTION

The inventors have realized that the predistortion method introduced by Livingston and Williams can be improved by removing the constraint that the poles must be shifted by the same amount. Accordingly, an adaptive predistortion method, in accordance with the present invention, involves predistorting the position of the poles in an adaptive fashion such that the position of at least some of the poles are shifted by differing amounts to improve at least one property of the realized filter such as insertion loss, group delay, etc. Alternatively, the method may involve adaptive predistortion for simultaneous improvement of amplitude and group delay.

The adaptive predistortion method may be applied to a filter that utilizes resonators with a high Q factor to improve the performance of the filter. Alternatively, the adaptive predistortion method may be applied to a filter that utilizes resonators with a low Q factor to allow the filter to emulate the performance of a high Q factor. This is beneficial since a filter having a low Q factor is lighter and smaller than a filter having a high Q factor. Accordingly, the smaller, lighter low Q factor filter, designed using adaptive predistortion, may be used in space craft applications in which the size and mass of payloads are constrained.

As previously mentioned, the design of a filter begins with the definition of a transfer function as given by equation 1 and reproduced below for convenience.

$$H(s) = \frac{D(s)}{E(s)} \quad (1)$$

In this form, the transfer function H(s) is also known as the s parameter $S_{21}$ which is a measure of the transmission of energy through the filter. The filter design process involves synthesizing the poles and zeros of the transfer function H(s) and selecting values for the poles and zeros to satisfy performance constraints.

Figure 1A:
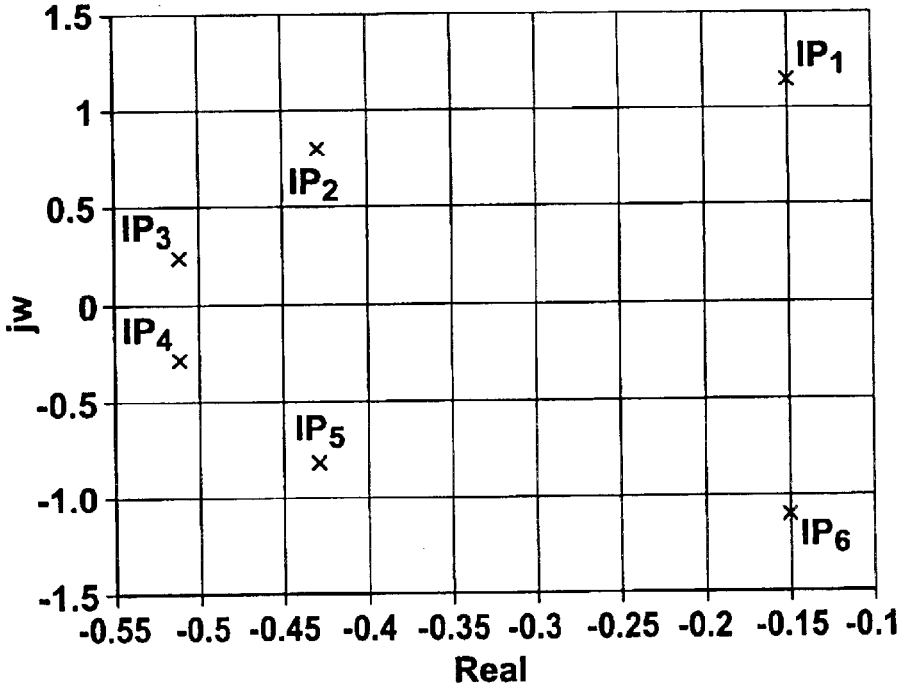
FIG. 1*a* is a plot of the poles of an exemplary transfer function.

Referring now to FIG. 1*a*, shown therein is a plot of the poles $IP_1, \ldots, IP_6$ of an ideal (i.e. infinite Q factor) six-order filter shown for exemplary purposes. The filter has 2 pairs of transmission zeros at +/−1.822j and +/−1.081 which are not shown and six poles. The approximate location of pole $IP_1$ is −0.149+1.116j, pole $IP_2$ is −0.429+0.791j, pole $IP_3$ is −0.511+0.254j, pole $IP_4$ is 0.511−0.254j, pole $IP_5$ is −0.429−0.791j and pole $IP_6$ is −0.149−1.116j. The return loss of the ideal filter is −22 dB.

Simulation of these poles and zeros will indicate the performance of the ideal (i.e. lossless) filter. However, one skilled in the art will realize that when a filter is realized (i.e. built) having the poles and zeros shown above, the performance of the realized filter will not be the same as the ideal (lossless) filter since the resonators used in the realization of the filter have a finite Q factor. The finite Q factor used for the resonators has the effect of shifting the poles $IP_1, \ldots, IP_6$ to the left, away from the jw axis, by an amount related to the finite Q factor which results in a degradation in the performance of the realized filter.

In an attempt to compensate for this effect, the prior art method of predistortion of the poles moves the poles to the right by a certain amount related to the Q factor of the realized filter. Mathematically, this is represented as follows. The factorized polynomial for the denominator polynomial E(s) is:

$$E(s)=c(s-p_1)(s-p_2)\ldots(s-p_n) \quad (2)$$

where c is a constant, $p_i$ is the $i^{th}$ root of E(s) and n is the order of the filter. The prior art predistortion method involves modeling the non-ideal effects of realizing a filter with finite Q factor resonators by a dissipation factor r given by equation 3:

$$r = \frac{1}{Q \cdot F_{BW}} \quad (3)$$

where Q is the finite Q factor of the resonators used for the realized filter and $F_{BW}$ is the fractional bandwidth of the filter which is the 3 dB bandwidth of the filter divided by the center frequency of the filter. The prior art predistortion method involves shifting the poles by a value $r_o$ where $0<r_o<r$. The factorized denominator polynomial E'(s) is now given by equation 4.

$$E'(s)=c[s-(p_1-r_o)]\cdot[s-(p_2-r_o)]\ldots[s-(p_n-r_o)] \quad (4)$$

Figure 1B:
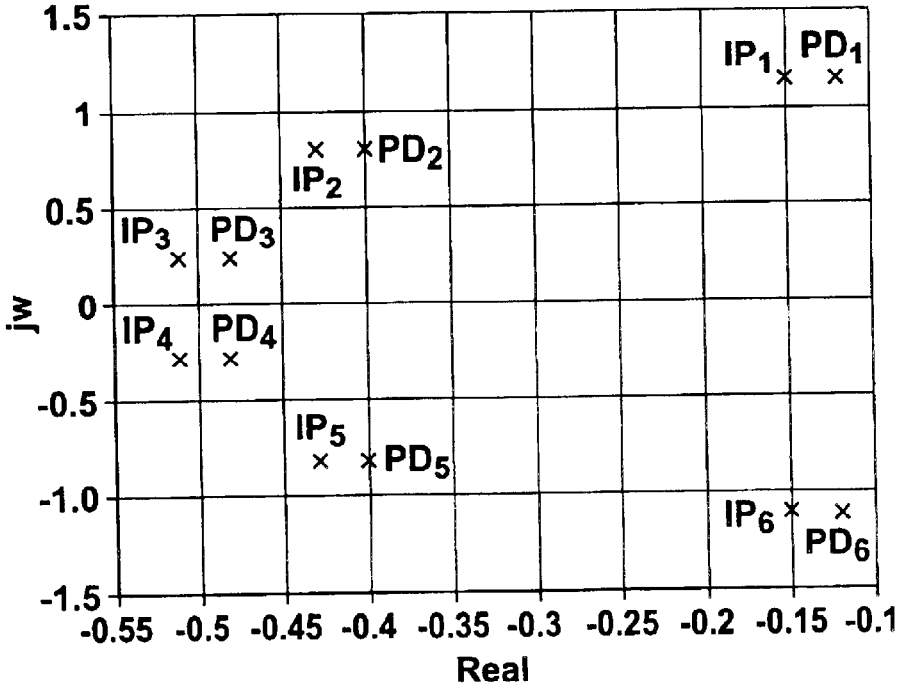
FIG. 1*b* is a plot of the poles of the exemplary transfer function of FIG. 1*a* after being subjected to prior art predistortion.

Continuing with the pole-zero example introduced earlier, the prior art predistortion method can be used to shift the poles to the right by 0.0286 to provide the performance of a realized filter having a Q factor of 20,000. The location of these poles $PD_1, \ldots, PD_6$ are shown in FIG. 1*b* relative to poles $IP_1, \ldots, IP_6$. The approximate location of pole $PD_1$ is −0.121+1.116j, pole $PD_2$ is −0.401+0.791j, pole $PD_3$ is −0.482+0.254j, pole $PD_4$ is −0.482−0.254j, pole $PD_5$ is −0.401−0.791j and pole $PD_6$ is −0.121−1.116j. However, predistortion of the poles comes at a penalty since the insertion loss of the realized filter is −2.08 dB and the return loss is −7.67 dB. In comparison, a realized filter that has not been designed using predistortion has an insertion loss of −1.3 dB. The difference between the insertion loss of the predistorted filter and the insertion loss of the conventional filter will increase for a higher order filter as will be shown in another example below.

The adaptive predistortion method of the present invention, compensates for the effect of using a finite Q factor resonators in the realized filter, without suffering the same performance degradation of the prior art predistortion method. In the adaptive predistortion method, the poles are adaptively predistorted by shifting the poles by varying amounts rather than by shifting each pole by a constant $r_o$. In mathematical terms, this results in a factorized denominator polynomial E"(s) as given in equation 5.

$$E''(s)=c[s-(p_1-a_1)]\cdot[s-(p_2-a_2)]\ldots[s-(p_n-a_n)] \quad (5)$$

where $a_i$ (i=1, 2, . . . , n) are a set of adaptive factors. The adaptive factors $a_i$ are chosen such that these factors do not all share the same value. Therefore, at least one of the adaptive factors $a_i$ has a value that is different from the remaining factors. Examples of sets of adaptive factors are shown further below. However, the value of each adaptive factor $a_i$ is constrained such that the filter obeys the law of physical realizability as is well known to those skilled in the art. Accordingly, each pole is shifted such that it remains in the left hand side of the complex plane. This constraint is indicated by equation 6.

$$\text{real}[p_i-a_i]<0,\ i=1, 2, \ldots, n \quad (6)$$

The ability to shift each of the poles by different amounts with respect to one another allows for the optimization of the filter performance.

Figure 1C:
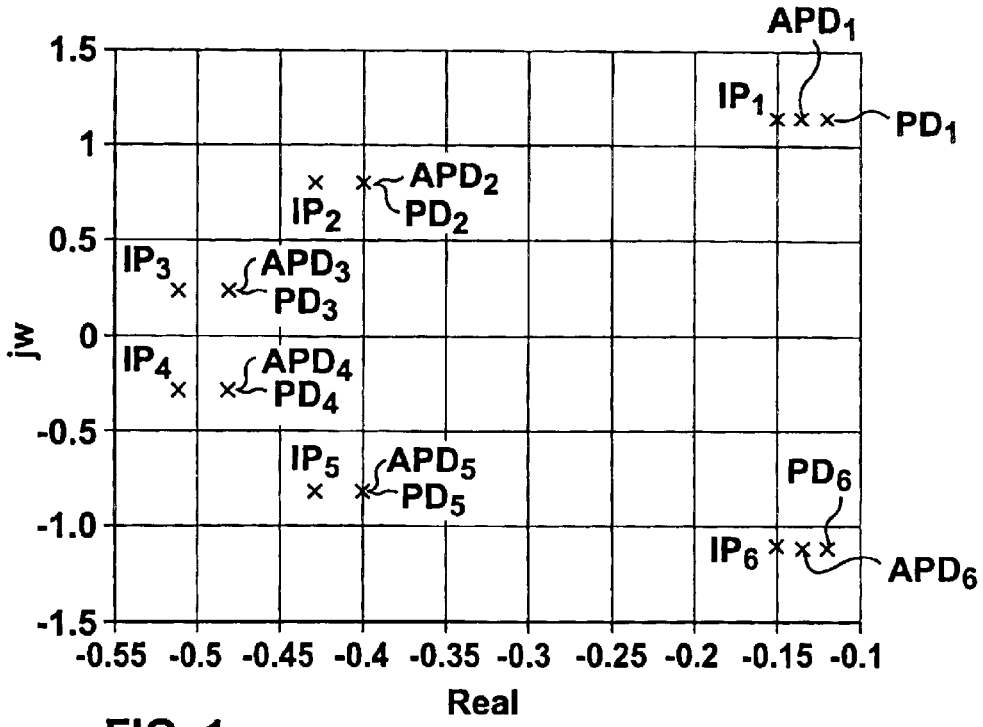
FIG. 1*c* is a plot of the poles of the exemplary transfer function of FIG. 1*a* after being subjected to adaptive predistortion in accordance with one embodiment of the present invention.

Continuing with the pole-zero example introduced earlier, as an example, the adaptive predistortion method in accordance with the present invention, can be used to shift the poles to the right by approximately 0.0286 except for the two poles that are closest to the jw axis which are moved 40% less. The location of these adaptively predistorted poles $APD_1, \ldots, APD_6$ are shown in FIG. 1*c* relative to the location of predistorted poles $PD_1, \ldots, PD_6$ and ideal poles $IP_1, \ldots, IP_6$. The location of the poles $APD_2, \ldots, APD_5$ are the same as those of $PD_2, \ldots, PD_5$ while the approximate location of pole $APD_1$ is −0.133+1.116j and pole $APD_6$ is −0.133−1.116j. In this example, the poles have been adaptively predistorted so that the realized filter emulates a filter with a Q factor of 20,000 with significantly improved performance over the filter realized by the prior art predistortion case. The insertion loss of the realized adaptively predistorted filter is −1.57 dB and the return loss is −11.68 dB. Accordingly, the performance of a realized filter that has its poles adaptively predistorted is better than the performance of a corresponding realized filter that has its poles predistorted. This effect becomes more pronounced as the order of the filter increases as will be shown with another example below.

Figure 2:
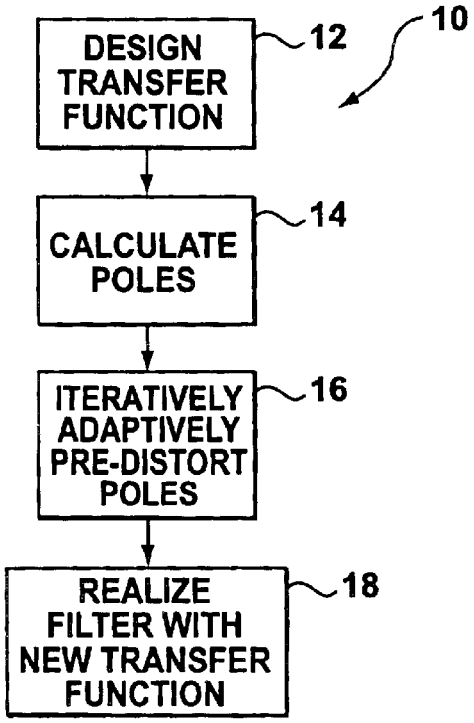
FIG. 2 is a flow-chart of an adaptive predistortion filter design method in accordance with one embodiment of the present invention.

Referring now to FIG. 2, shown therein is a process 10 for the adaptive predistortion method of the present invention. The adaptive predistortion process 10 begins at step 12 where the transfer function of a filter is designed. This involves selecting a particular passband for the filter (i.e. bandpass, lowpass, highpass, etc.) and selecting a particular type of transfer function for the filter (i.e. Chebychev, elliptical, etc.). Also in step 12, the performance criteria for the filter can be selected for at least one property of the filter such as insertion loss, loss variation and group delay. Alternatively, this may include simultaneously specifying the insertion loss and group delay performance criteria. It is understood to those skilled in the art how these performance criteria are specified.

Step 12 also includes selecting a resonator type having a certain Q factor. One may choose a resonator having a high Q factor value such as at least 6,000 to improve the performance of the realized filter. Alternatively, and more advantageously, one may select a resonator having a low Q factor value since the adaptive predistortion method of the invention allows a low Q factor filter, which has a Q factor on the order of 2,000 to 5,000, to emulate a higher Q factor filter as an example. In other applications, it may be possible to extend the lower limit to less than 2,000 such as 1,500 or 1,000 for example. This allows for the reduction of the mass and size of the microwave filter while using the adaptive predistortion method to recover the degradation that is associated with using low Q factor resonators.

The adaptive predistortion process 10 then moves to step 14 where the poles of the designed transfer function are calculated. As mentioned previously, these poles are associated with an ideal or lossless filter. The adaptive predistortion process 10 then moves to step 16 where the poles of the transfer function are adaptively predistorted using a set of adaptive factors $a_i$. Step 16 involves performing at least one iteration of the adaptive predistortion of the poles. At this point, the transfer function that results from the adaptively predistorted of the poles is calculated to determine if the resulting transfer function is close to the desired transfer function specified in step 12. This may be done by visual inspection by a filter designer. If the resulting transfer function is acceptable, the process 10 moves to step 18 where the filter is realized. However, if the resulting transfer function is not acceptable, several iterations of adaptively predistorting the poles may need to be done.

In step 16, values for the adaptive factors $a_i$ can be set in an ad hoc fashion as long as there is at least one unique value for the set of adaptive factors $a_i$. Alternatively, a more orderly fashion of selecting values for the set of adaptive factors $a_i$ involves ordering the poles in a counter-clockwise fashion, beginning with the topmost pole as was done in each of FIGS. 1*a*–1*c* with the subscripts of the poles indicating the ordering of the poles. In this case, the poles closest to the jω axis are at the beginning and the end of the ordered set of the poles. A variety of piecewise linear functions can then be used to define the values for the adaptive factors $a_i$.

Figure 3A:
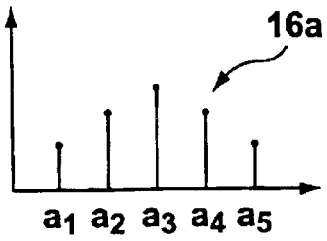
FIG. 3*a* is an example of a function used to select values for adaptive factors used in the adaptive predistortion method.

For instance, referring to FIG. 3*a*, and using a $5^{th}$ order filter as an example, a piecewise linear sinusoidal function 16*a* may be used to select the values of the adaptive factors $a_i$. In this case, the value of each adaptive factor $a_i$ is given by equation 7.

$$a_i = 0.1r\sin\left[\frac{(i-1)\pi}{2(n-1)}\right] \tag{7}$$

Using a piecewise sinusoidal function will ensure that each adaptive factor $a_i$ is changed at a different rate. Various scaling factors can be used rather than 0.1r to change the values of the adaptive factors $a_i$.

Figure 3B:
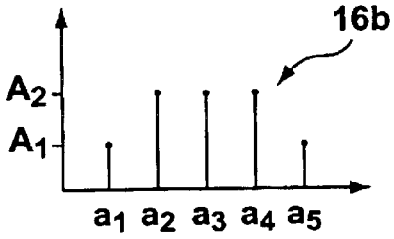
FIG. 3*b* is another example of a function used to select values for adaptive factors used in the adaptive predistortion method.

Referring now to FIG. 3*b*, shown therein is an alternative piecewise linear function 16*b* which is in the form of a linear staircase function. In this case, the first and last poles are shifted by a first amount $A_1$ while each of the other poles are shifted by a second amount $A_2$. The amounts $A_1$ and $A_2$ can be related to the parameter r. A variety of values can be used for the first and second amounts $A_1$ and $A_2$ to shift the poles by varying amounts relative to one another.

Figure 3C:
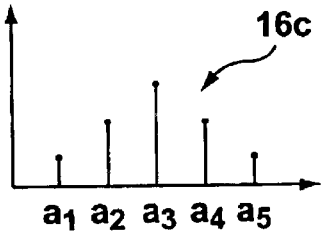
FIG. 3*c* is another example of a function used to select values for adaptive factors used in the adaptive predistortion method.

Referring now to FIG. 3*c*, shown therein is another alternative piecewise linear function 16*c* which is in the form of a triangular staircase function. In this case, the value of each adaptive factor $a_i$ is given by equations 8*a* and 8*b*.

$$a_i = d \cdot i + c_o \text{ for } i=1, 2, \ldots, (n+1)/2 \tag{8a}$$

$$a_i = a_{n-i+1} \text{ for } i=(n+1)/2+1, \ldots, n \tag{8b}$$

assuming that n is odd (if n is even then (n+1)/2 is replaced by n/2). The parameter d is a constant that sets the slope of the triangular staircase function and may be related to the parameter r. The parameter $c_o$ is a constant that can be used to shift the staircase higher or lower. In this case, each pole is shifted by a different amount.

Figure 3D:
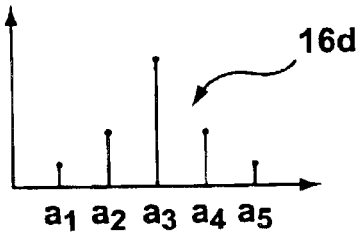
FIG. 3*d* is another example of a function used to select values for adaptive factors in the adaptive predistortion method.

Referring now to FIG. 3*d*, shown therein is another alternative piecewise linear function 16*d* which is in the form of an exponential function. In this case, the value of each adaptive factor $a_i$ is given by equations 9*a* and 9*b*.

$$a_i = e^{gi} + h_o \text{ for } i=1, 2, \ldots, (n+1)/2 \tag{9a}$$

$$a_i = a_{n-i+1} \text{ for } i=(n+1)/2+1, \ldots, n \tag{9b}$$

assuming that n is odd (if n is even then (n+1)/2 is replaced by n/2). The parameter g is a constant that sets the slope of the exponential envelope of the staircase function 16*d* and the parameter $h_o$ is a constant that adds an offset to the staircase function 16*d*. Once again, the value of each adaptive factor is unique in this example.

In each of the examples given above, there is symmetry in the values of the adaptive factors $a_i$. However, in an alternative, the values of the adaptive factors $a_i$ may be changed so that there is no longer symmetry about the middle adaptive factor which occurs at index i=(n+1)/2 for n odd or i=n/2 for n even. Furthermore, other types of piecewise linear functions may be used, and those shown above are for exemplary purposes only.

Although the values of the adaptive factors $a_i$ may be chosen in an ad hoc fashion, as mentioned previously, it is preferable to select the adaptive factors $a_i$ such that the adaptive factors that correspond to the poles which are closest to the jw axis are distorted by a smaller amount than the remainder of the poles. This is preferable since the poles that are nearest to the jω axis have a larger effect on the performance of the realized filter. By shifting the poles near the jω axis by a smaller amount than the remainder of the poles, the degradation in insertion loss is reduced and the amount of return loss is increased.

Referring once more to FIG. 2, the adaptive predistortion process 10 then moves to step 18 where an adaptive predistorted filter is realized with a new transfer function having the new adaptively predistorted poles. In this step, a coupling matrix is generated which defines the amount and type of coupling between the various resonators of the realized filter. Therefore, the Q factor of the physical resonators, and hence the size of the resonators, that was chosen in step 12 is still used to construct the realized filter. However, the adaptive predistortion of the poles alters the coupling between these resonators such that the realized filter behaves as if it were constructed using physical resonators that have a higher Q factor. This higher Q factor is dictated by the amount of shifting of the poles that was done in step 16. The end result is a physically smaller filter that emulates a higher Q factor. This allows inexpensive filters having lower Q factors such as coaxial resonator filters to be used rather than waveguide or dielectric resonator filters.

A variety of different techniques may be used in step 18 to realize the filter as is commonly known to those skilled in the art. These include using doubly-terminated LC network theory (Guillemin, E. A., Synthesis of Passive Networks, John Wiley and Sons, 1957), general folded, cross-coupled networks or folded, cross-coupled networks with diagonal cross-coupling admittance inverters (R. J. Cameron, "General Prototype Network-Synthesis Methods For Microwave Filters", ESA Journal 1982, Volume 6, pages 193–206.) or any other suitable techniques. Step 18 would also include tuning the resulting realized filter. Computer aided tuning techniques may be used to aid in tuning as is well known to those skilled in the art.

Figure 4:
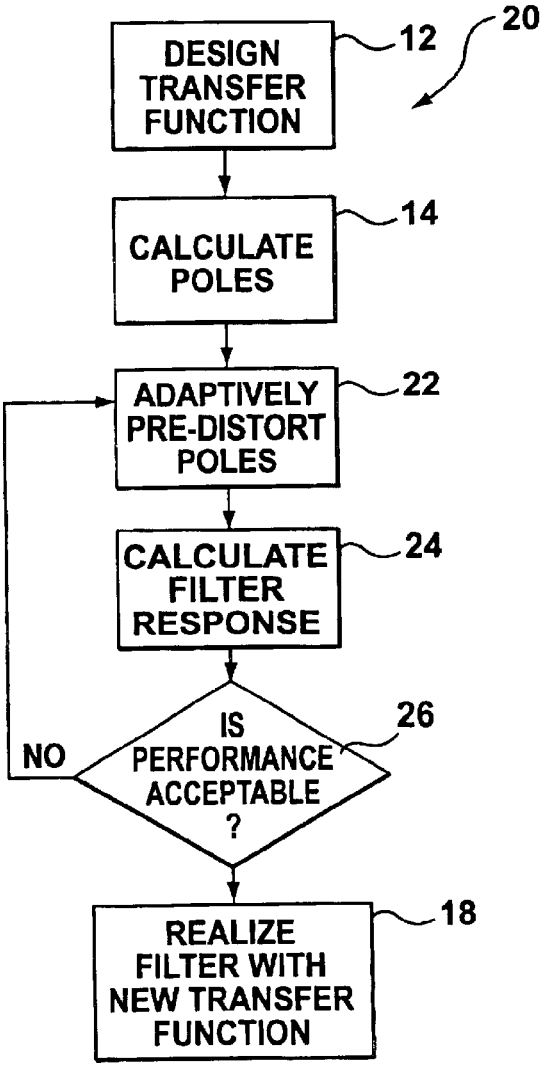
FIG. 4 is a flow-chart of an alternative version of the adaptive predistortion method in accordance with another embodiment of the present invention.

Referring now to FIG. 4, an alternative adaptive predistortion process 20 in accordance with another embodiment of the invention is shown which comprises much of the steps of adaptive predistortion process 10 except that step 16 is now replaced by three steps 22, 24 and 26. After the poles of the transfer function are calculated in step 14, the poles of the transfer function of the filter are initially adaptively predistorted as described above. In step 24, the transfer function F(s) of the filter with the adaptively predistorted poles is calculated. In step 26, the transfer function F(s) is compared with the transfer function R(s) which results from the specification in step 12 of the performance criteria for at least one property of the designed transfer function. This comparison involves examining the difference between these two functions according to equation 10.

$$D(s)=F(s)-R(s) \tag{10}$$

It should be noted that the difference transfer function D(s) retains both magnitude and phase information.

Preferably, the filter designer uses computer optimization techniques to carry out steps 22 to 26. Accordingly, the poles of the transfer function are initially shifted in an adaptive predistortion fashion which may involve the use of any of the piece-wise linear functions mentioned above. The locations of these initially shifted poles are provided to the computer optimization program which then calculates the difference function D(s) and attempts to minimize D(s) to optimize the performance of the filter represented by the transfer function F(s) by adaptively predistorting the pole locations while satisfying equation 6. The computer optimization program selects new values for the adaptive factors $a_i$ which may or may not retain the shape of the piece-wise linear function used for the initial adaptive predistortion of the poles. Any computer optimization technique may be used, as is commonly known to those skilled in the art, such as the least squares method or the gradient based optimization method. Once the optimization method selects a set of adaptively predistorted poles to minimize D(s), the process 20 moves to step 18 where the filter is realized and tuned if necessary.

It should be noted that it is preferable to provide a piecewise linear function as described above so that the poles near the jω) axis are shifted by a smaller value than the remainder of the poles. This will allow the resulting realized filter to have a reduced amount of insertion loss and an increased amount of return loss which are both desirable. In addition, setting the initial shift of the poles in this manner may allow the optimization program to converge at a faster rate.

As mentioned previously, one may choose a resonator having a low Q factor value in step 12 since the adaptive predistortion method of the invention allows a filter which utilizes low Q factor resonators to emulate a filter that utilizes higher Q factor resonators. However, the process 20 also allows the group delay and the amplitude of the realized filter to be simultaneously optimized for the best performance possible for low Q factor resonators since both the magnitude and phase information are retained in the difference transfer function D(s). The loss variation of the resulting realized filter is also improved.

In another example, a $10^{th}$ order filter typically used for satellite communications was realized using the prior art predistortion method and the adaptive predistortion method. The prior art predistortion method was applied to a filter which uses resonators having a Q factor of 8,000 while the adaptive predistortion method was applied to a filter which was realized with coaxial resonators having a Q factor of approximately 3,000 such that the resulting realized filter would emulate the performance of a filter having a Q factor of 8,000. Accordingly, in this example, using predistortion has resulted in an improvement in the Q factor of at least 100% with an acceptable insertion loss penalty as discussed below. The performance results of the realized filters are shown in Table 1. The results indicate that the adaptive predistortion method results in a 2.8 dB improvement in insertion loss and 3.4 dB improvement in return loss over the prior art predistortion method.

TABLE 1

| Parameters | Adaptive Predistortion Method | Prior Art Predistortion Method |
|---|---|---|
| Insertion loss (dB) | −5.0 | −6.9 |
| Return Loss (dB) | −3.6 | −2.0 |

In comparison, a conventional dielectric resonator filter has a typical insertion loss of approximately −1.2 dB. Accordingly, using the prior art predistortion method leads to an extra insertion loss of 5.7 dB, while the adaptive predistortion method increases the insertion loss by only 3.8 dB. The increase in insertion loss of 3.8 dB is acceptable since the realized filter is typically incorporated with a low noise amplifier in a satellite communication system and the gain of the low noise amplifier can be increased by 3.8 dB to recover the insertion loss whereas a gain increase of 5.7 dB is more problematic. Accordingly, an adaptively predistorted filter may be a direct "drop in" replacement of the current IMUX filters used in satellite communication systems.

Figure 5A:
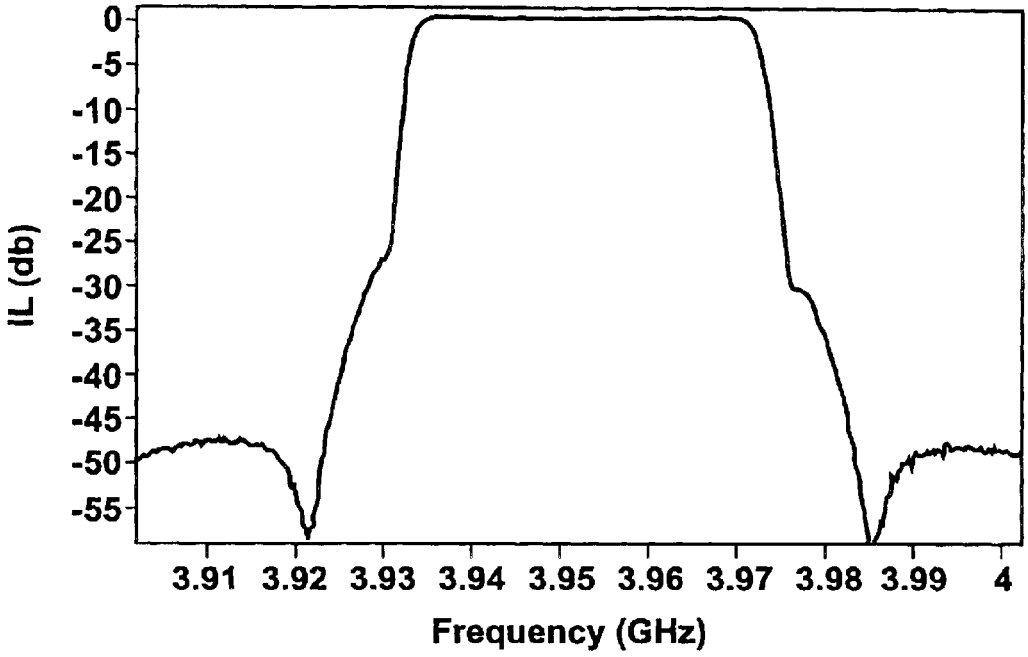
FIG. 5*a* is a plot of normalized insertion loss (normalized to 5 dB) for another exemplary transfer function resulting from adaptive predistortion.
Figure 5B:
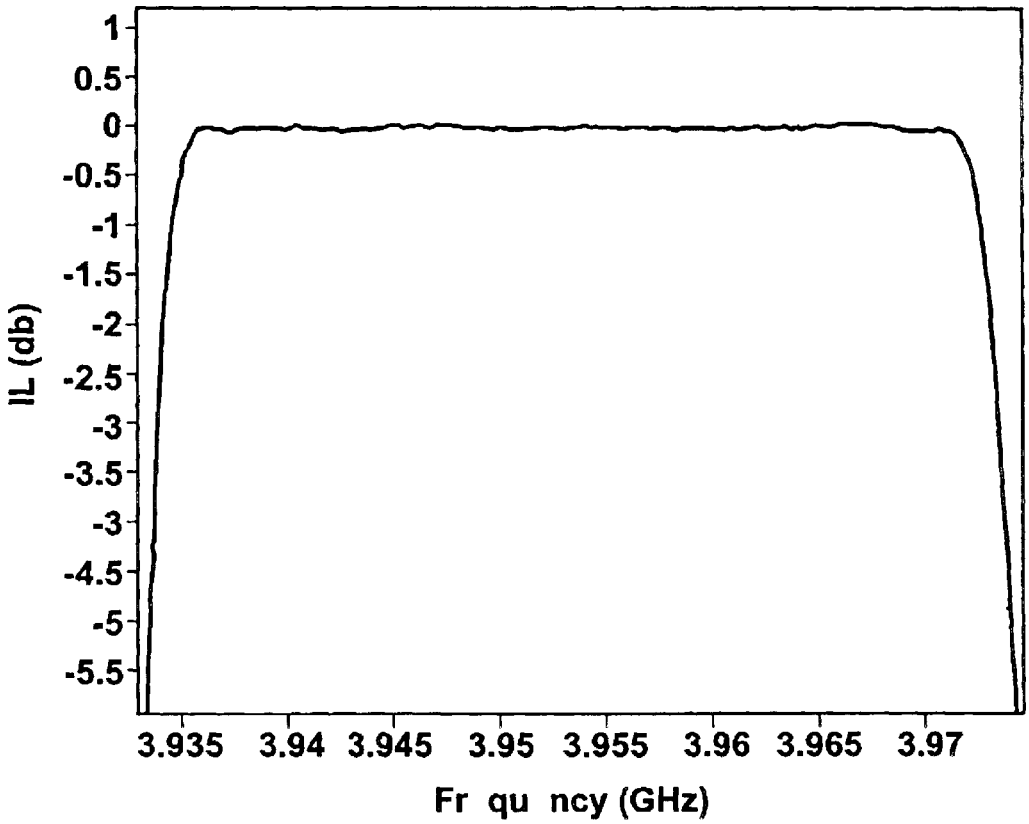
FIG. 5*b* is a magnified plot of the insertion loss (normalized to 5 dB) of FIG. 5*a* showing loss variation.
Figure 5C:
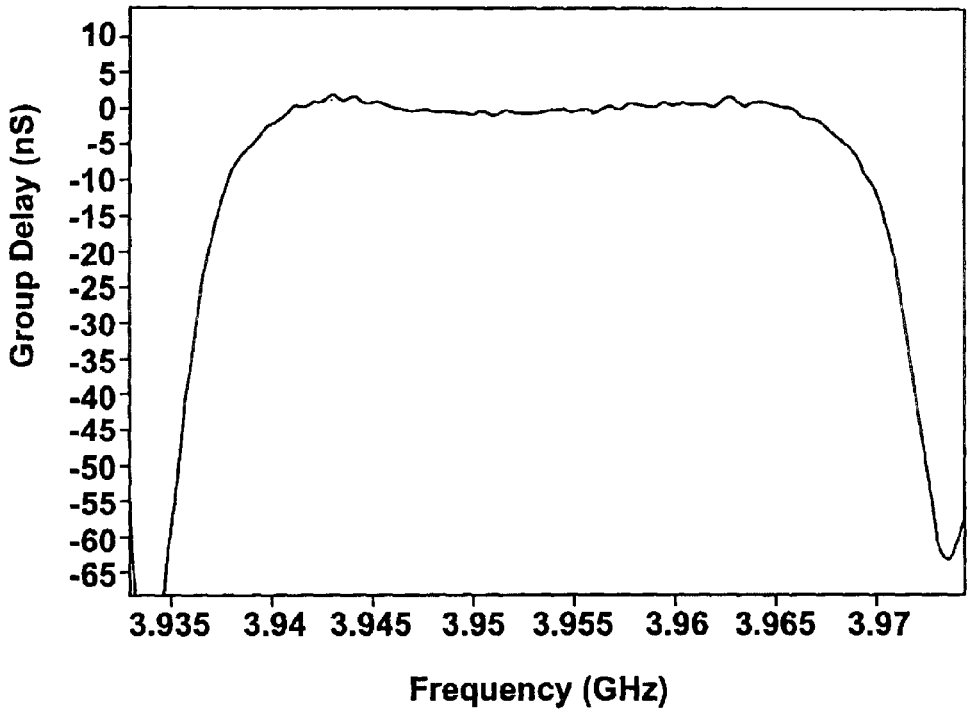
FIG. 5*c* is a plot of normalized group delay for the exemplary transfer function of FIG. 5*a;*

Referring now to FIGS. 5*a*-5*c*, the performance of the adaptively predistorted 10 pole filter of Table 1 is shown. FIG. 5*a* shows a plot of normalized insertion loss (which is equivalent to the magnitude of the transfer function) versus frequency. FIG. 5*a* shows that the insertion loss is very flat in the passband and that the transition between the passband and the stopband is also quite sharp. FIG. 5*b* shows a magnified view of the insertion loss of FIG. 5*a* in the passband which shows that the variation in the insertion loss is on the order of a tenth of a dB. FIG. 5*c* shows the group delay in the passband of the adaptively predistorted filter. The group delay is quite flat with a variation on the order of a few nanoseconds.

Figure 6A:
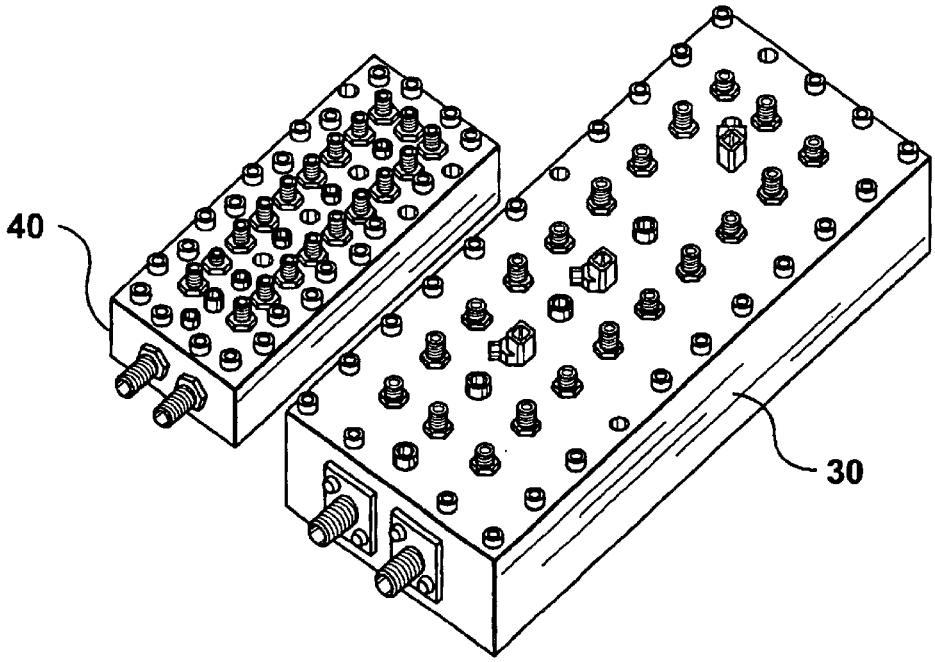
FIG. 6*a* shows a realized adaptively predistorted filter having the properties of FIGS. 5*a* to 5*c* in comparison with a conventional filter having a Q factor of 8,000.

Referring now to FIG. 6*a*, a diagram is shown of a typical dielectric resonator filter 30 which has a Q factor of 8,000. Also shown is a physical realization 40 of the adaptively predistorted 10 pole filter of Table 1 in the form of a coaxial resonator filter. The dielectric resonator filter 30 is what is typically used for input multiplexers in spacecraft applications. Both filters 30 and 40 are of the same order and have similar performance in the same frequency band. However, the volume and mass of the adaptive predistortion filter 40 are approximately 25% and 35% respectively of the conventional dielectric resonator filter 30 which is very beneficial for applications in which size and mass are important. This is also beneficial from a cost perspective since coaxial resonator filters are less expensive than dielectric resonator filters. Furthermore, as previously mentioned, the adaptive predistortion method allows the realized filter to simultaneously achieve lower insertion loss with group delay equalization.

Figure 6B:
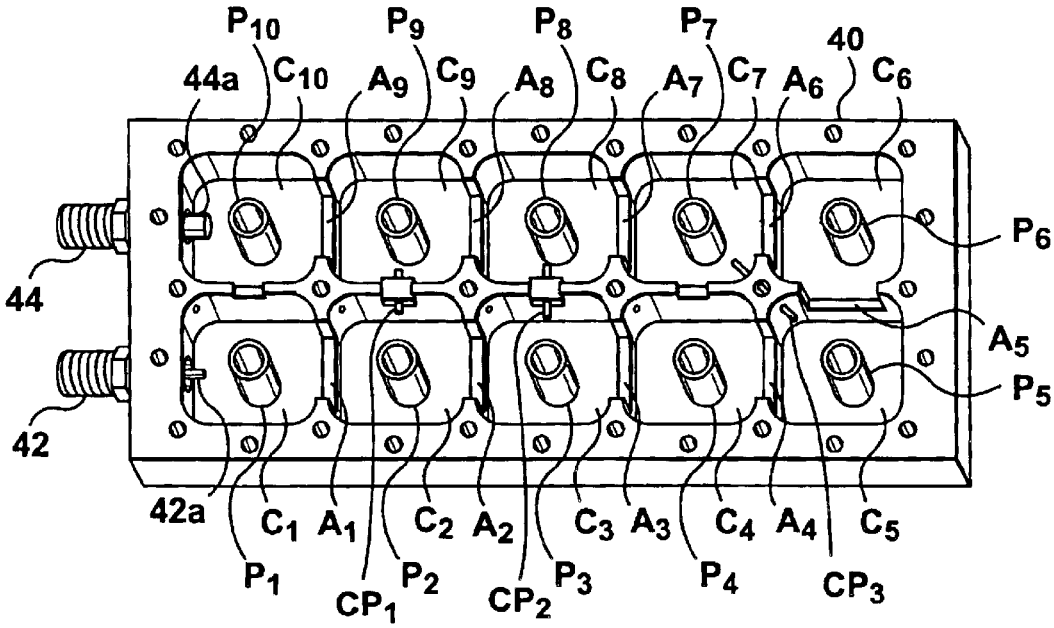
FIG. 6*b* shows the interior of the realized adaptively predistorted filter of FIG. 6*a;*

Referring now to FIG. 6*b*, shown therein is the interior of the adaptively predistorted coaxial resonator filter 40. The filter 40 comprises an input probe 42 for receiving input electromagnetic energy and an output probe 44 for providing output filtered electromagnetic energy. The input probe 42 and the output probe 44 both respectively have a coupling element 42*a* and 44*a* for coupling energy to/from the filter 40. The size and location of the input prove 42 and the output probe 44, which determines the amount of electromagnetic coupling into and out of the filter 40, are different than those of other conventional prior art filters which have input and output probes with similar, if not identical, size and location.

The filter 40 further comprises a plurality of resonator cavities $C_1, \ldots, C_{10}$. Each resonator cavity $C_1, \ldots, C_{10}$ has a respective post $P_1, \ldots, P_{10}$ and a respective aperture $A_1, \ldots, A_9$. The posts $P_1, \ldots, P_{10}$ are used to lower the resonance of the cavities $C_1, \ldots, C_{10}$. The apertures $A_1, \ldots, A_9$ couple the cavities sequentially (i.e. cavity $C_1$ is coupled to cavity $C_2$, cavity $C_2$ is coupled to cavity $C_3$ and so on. The filter 40 also has a number of coupling posts $CP_1$, $CP_2$ and $CP_3$ which respectively cross couple cavities $C_2$ and $C_9$, cavities $C_3$ and $C_8$ and cavities $C_5$ and $C_7$. There is also a "cross-coupling" aperture $A_{10}$ which couples cavities $C_1$ and $C_{10}$. The physical size of each cavity $C_1, \ldots, C_{10}$ and each post $P_1, \ldots, P_{10}$ is selected to provide a Q factor of 3,000. However, the amount of coupling that is provided by the apertures $A_1, \ldots, A_{10}$ and the coupling posts $CP_1$, $CP_2$ and $CP_3$ is related to the adaptive predistortion of the poles such that the filter 40 emulates a filter that is built with resonators having a Q factor of 8,000. In addition, the adaptive predistortion provides both group delay equalization and improvement of return loss for filter 40. Accordingly, adaptive predistortion has an effect on the size of the apertures $A_1, \ldots, A_{10}$ as well as the length and the diameter of the coupling posts $CP_1$, $CP_2$ and $CP_3$.

Figure 7:
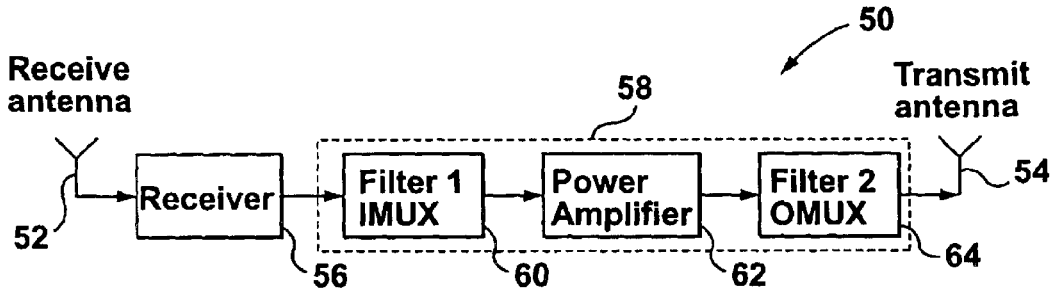
FIG. 7 is a block diagram of a simplified satellite communication system.

Referring now to FIG. 7, shown therein is a block diagram of a simplified satellite communication system 50 comprising a receive antenna 52 for receiving uplink signals from an earth station and a transmit antenna 54 for providing downlink signals to the same earth station or to a different earth station. The system 50 also comprises a receiver 56 and a plurality of sub-channels which have similar components wherein each of the sub-channels operate at different frequencies. For simplicity, only sub-channel 58 is shown. The receiver 56 receives and processes the uplink signal as is well known to those skilled in the art and provides a wideband signal to the sub-channels. The receiver 56 usually incorporates a low noise amplifier. The sub-channel 58 comprises an input multiplexing (IMUX) filter 60 for channelization (i.e. providing a bandpass signal corresponding to a certain channel), a power amplifier 62 for providing amplification to the bandpass signal, and an output multiplexer (OMUX) filter for providing an output signal that is recombined at the transmit antenna 54 with the output signals from the other sub-channels. A high Q factor filter is often used for the IMUX filter 60 and the most critical parameters for the IMUX filter 60 includes in-band performance such as loss variation and group delay. Accordingly, the adaptive predistortion method of the present invention may be used to provide the needed performance for the IMUX filter 60 with a physical realization that may preferably use low Q-factor resonators or alternatively high Q-factor resonators.

Figure 8A:
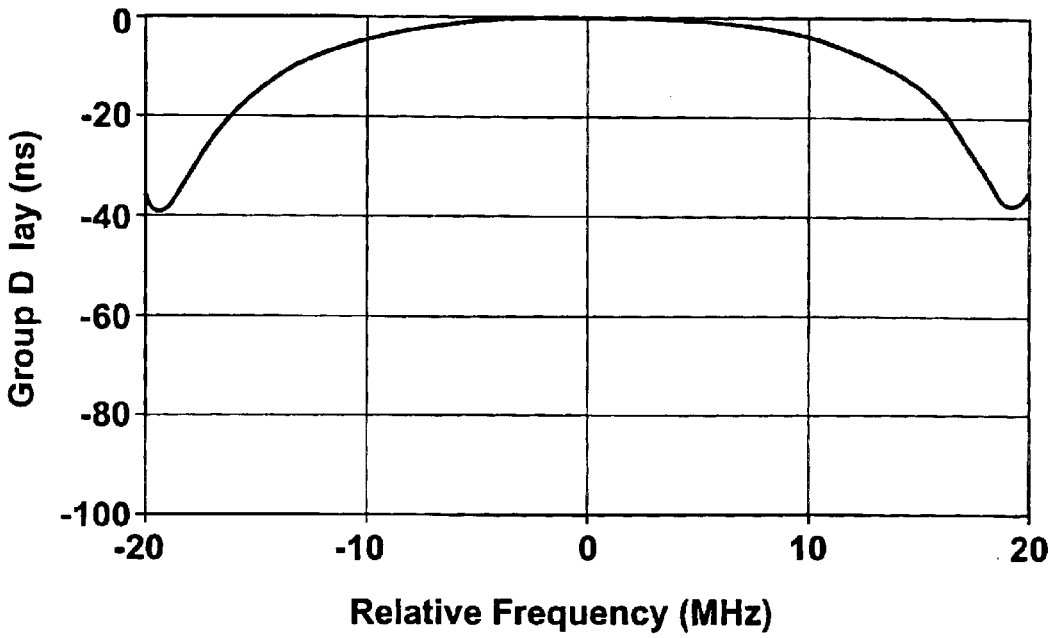
FIG. 8*a* is a plot of the group delay of the OMUX filter of FIG. 7.
Figure 8B:
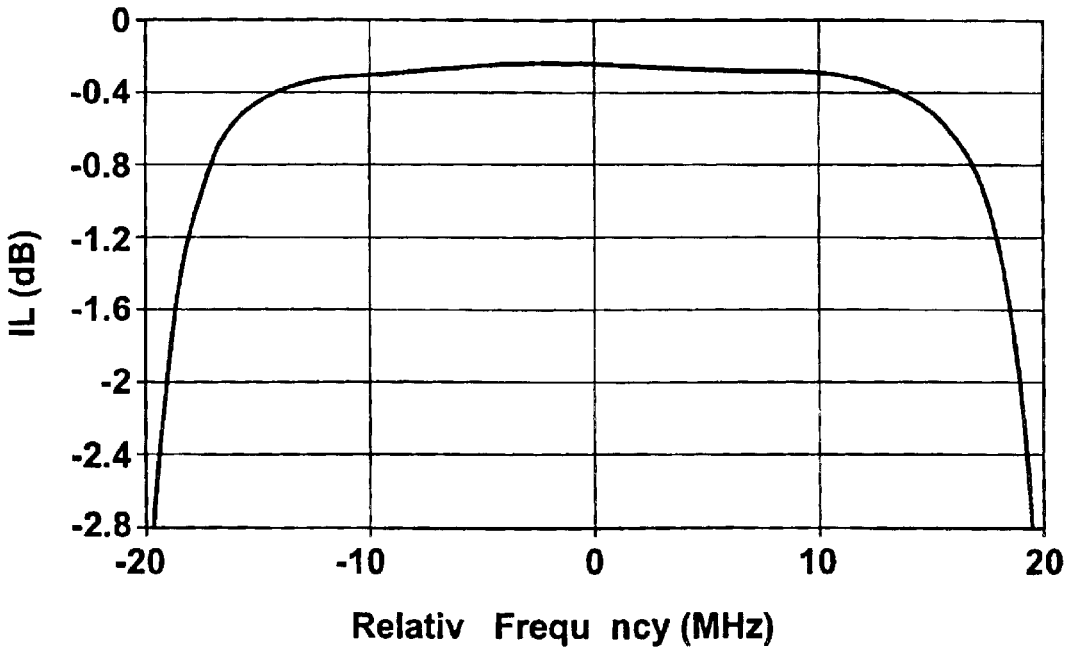
FIG. 8*b* is a plot of the insertion loss of the OMUX filter of FIG. 7.

The OMUX filter 64 is a high power device that can be subjected to tens or hundreds of Watts so it is important for the OMUX filter to have only a small amount of insertion loss. Accordingly, the OMUX filter 64 is often realized using a $4^{th}$ or $5^{th}$ order filter with one pair of transmission zeros. However, this leads to performance degradation as shown in FIGS. 8*a* and 8*b* (the frequency axis for FIGS. 8*a* to 11*b* are in MHz and centered at 4 GHz). FIG. 8*a* shows the group delay within the pass band of the OMUX filter 64. The group delay is not flat within the passband and suffers severe degradation near the transition bands. Group delay equalization may not be used on the OMUX filter 64 due to structure constraints. FIG. 8*b* shows a plot of the insertion loss of the OMUX filter 64. The insertion loss is not flat and has a severe roll-off near the transition bands of the OMUX filter 64.

Figure 9A:
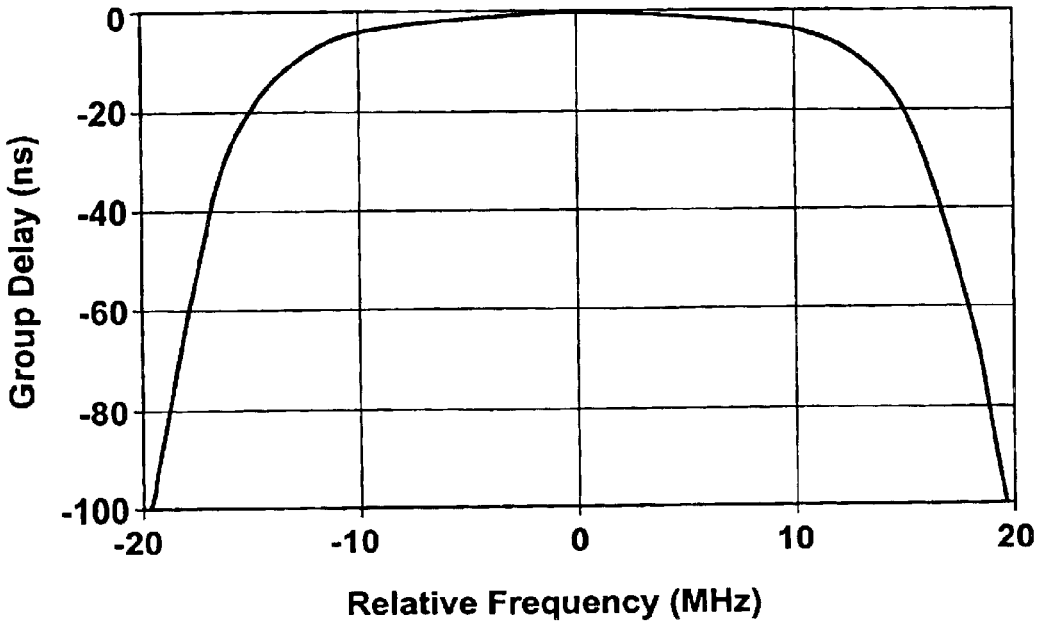
FIG. 9*a* is a plot of the of the group delay of the combination of the OMUX filter and IMUX filter of FIG. 7 for a conventional IMUX filter.
Figure 9B:
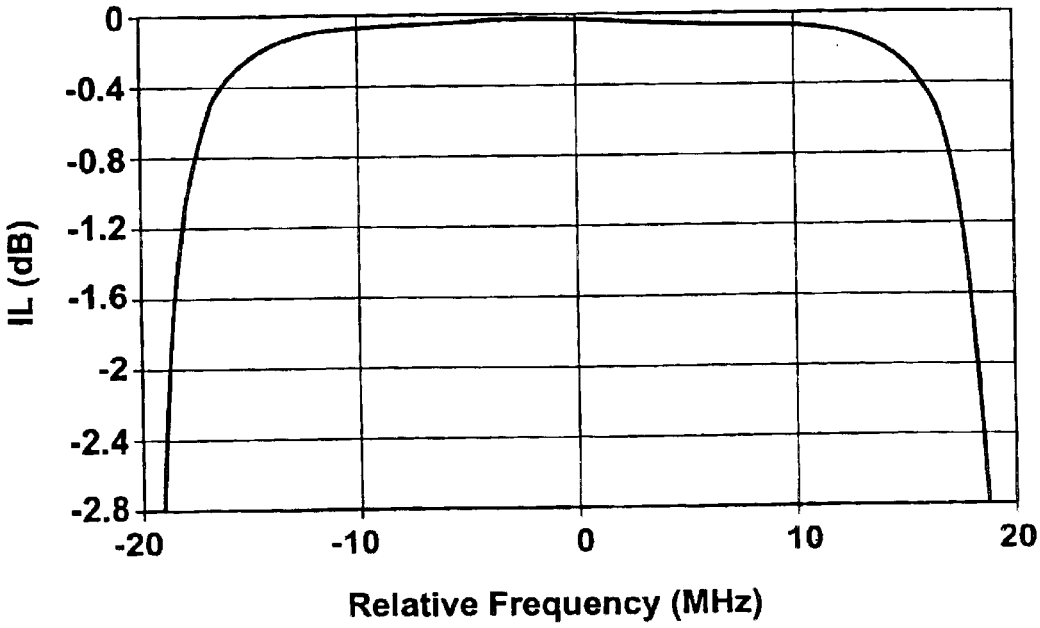
FIG. 9*b* is a plot of the insertion loss of the combination of the OMUX filter and IMUX filter of FIG. 7 for the conventional IMUX filter of FIG. 9*a;*

Referring now to FIGS. 9*a* and 9*b*, shown therein is the combined performance of the conventional IMUX filter 60 and the OMUX filter 64 (the power amplifier 62 is assumed to have linear performance in the passband of filters 60 and 64). FIG. 9*a* shows that the group delay for the combination of filters 60 and 64 is more rounded near the center of the passband as well as being more sloped near the transition bands in comparison with FIG. 8*a*. However, FIG. 9*b* shows that the insertion loss of the combination of filters 60 and 64 is not as large but is more rounded in the passband.

In order to improve the performance of the combination of the IMUX filter 60 and the OMUX filter 64, the adaptive predistortion method may be used. However, any extra insertion loss for the OMUX filter 64 introduced by adaptive predistortion is not desirable. Accordingly, the adaptive predistortion method may be applied to the IMUX filter 60 such that the overall performance of the combination of the IMUX filter 60 and the OMUX filter 64 is acceptable.

The adaptive predistortion process 20 may be used to design an over-compensated adaptively predistorted IMUX filter so that the performance of the combination of this IMUX filter with the OMUX filter 64 is improved. However, some of the steps of process 20 are altered. For instance, in step 12, the desired performance criteria for the transfer function of the combined filters is specified. Preferably, the combination of the over-compensated adaptively predistorted IMUX filter and the OMUX filter 64 has negligible insertion loss, negligible insertion loss variation and flat group delay. Based on the transfer function of the OMUX filter, an estimate is made of the transfer function of the over-compensated adaptively predistorted IMUX filter to achieve the desired performance criteria of the combined filters. In step 14 the poles of the estimated transfer function of the over-compensated adaptively predistorted IMUX filter are calculated and in step 22, these poles are adaptively predistorted so that at least one pole is shifted by a unique amount. Step 24 involves calculating the overall filter response of the over-compensated adaptively predistorted filter and the OMUX filter 64. This involves converting the transfer function of each of these filters into a t parameter matrix, as is commonly known in the art, and multiplying the two t parameter matrices together to obtain a product t parameter matrix, and converting the product t parameter matrix into a transfer function which will be referred to as the product transfer function. In step 26, the product transfer function is then compared to the desired transfer function (specified in step 12) to determine a difference transfer function (according to equation 10). Computer optimization is then preferably used to minimize the difference transfer function. The end result is that the poles of the over-compensated adaptively predistorted filter are shifted until the product transfer function is sufficiently close to the desired transfer function (i.e. the difference transfer function is preferably minimized).

Figure 10A:
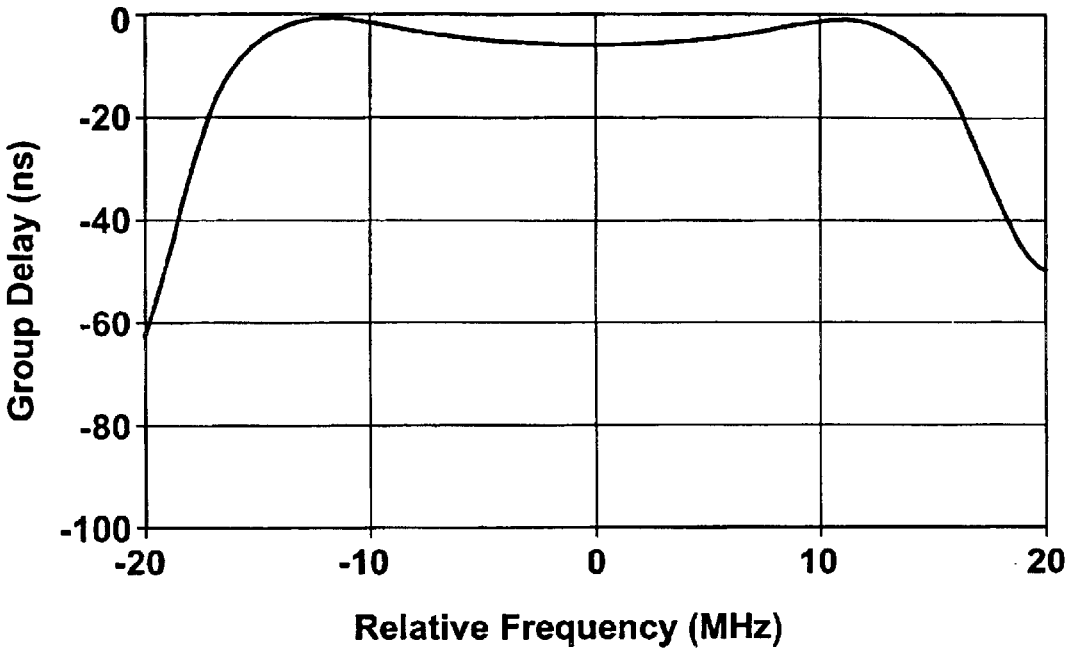
FIG. 10*a* is a plot of the group delay for an over-compensated adaptively predistorted IMUX filter.
Figure 10B:
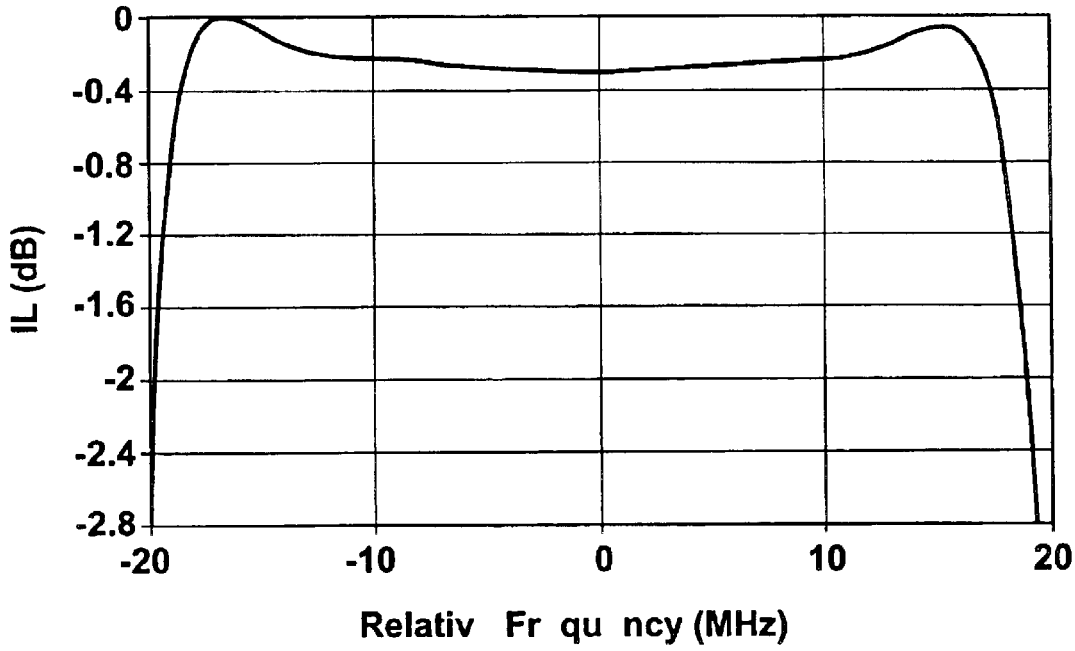
FIG. 10*b* is a plot of the insertion loss for an over-compensated adaptively predistorted IMUX filter.

Referring now to FIGS. 10*a* and 10*b*, shown therein is the performance of the over-compensated adaptively predistorted IMUX filter. FIG. 10*a* shows a plot of group delay and FIG. 10*b* shows a plot of insertion loss. In both cases, there is a "dip" in the middle of the pass band and a "hump" at each end of the passband. The dip is a result of the optimization of the performance of the overall filter matrix and acts to flatten out both the group delay and the insertion loss of the OMUX filter 64 within the passband, while the humps act to compensate for the roll-off effect of the OMUX filter 64 in the transition band.

Figure 11A:
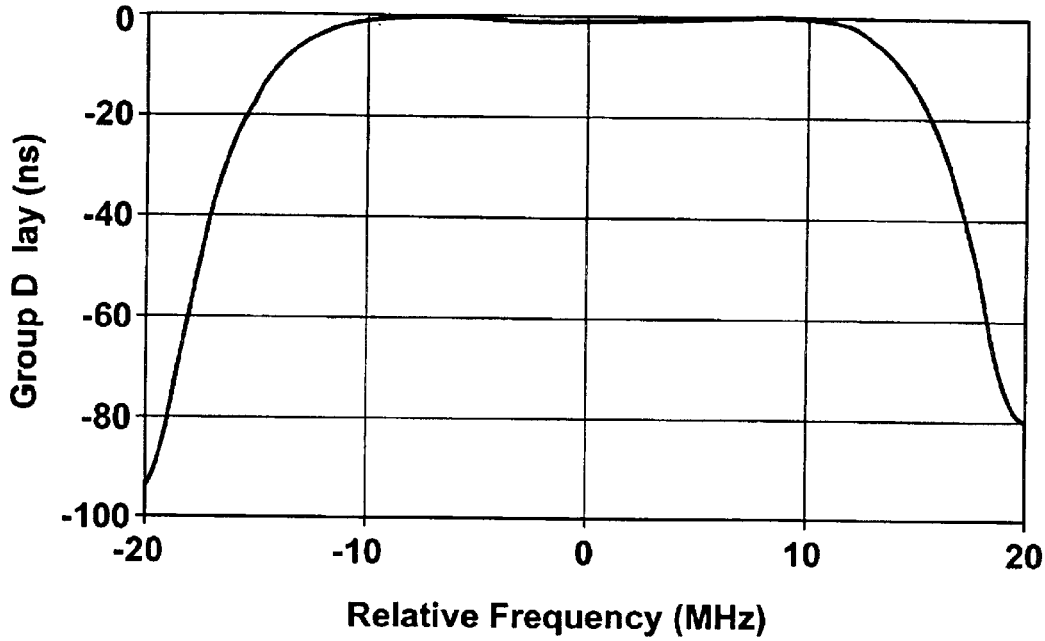
FIG. 11*a* is a plot of the group delay of the combination of the OMUX filter of FIGS. 8*a* and 8*b* and the over-compensated adaptively predistorted IMUX filter of FIGS. 10*a* and 10*b*; and, FIG. 11*b* is a plot of the insertion loss of the combination of the OMUX filter of FIGS. 8*a* and 8*b* and the over-compensated adaptively predistorted IMUX filter of FIGS. 10*a* and 10*b*.
Figure 11B:
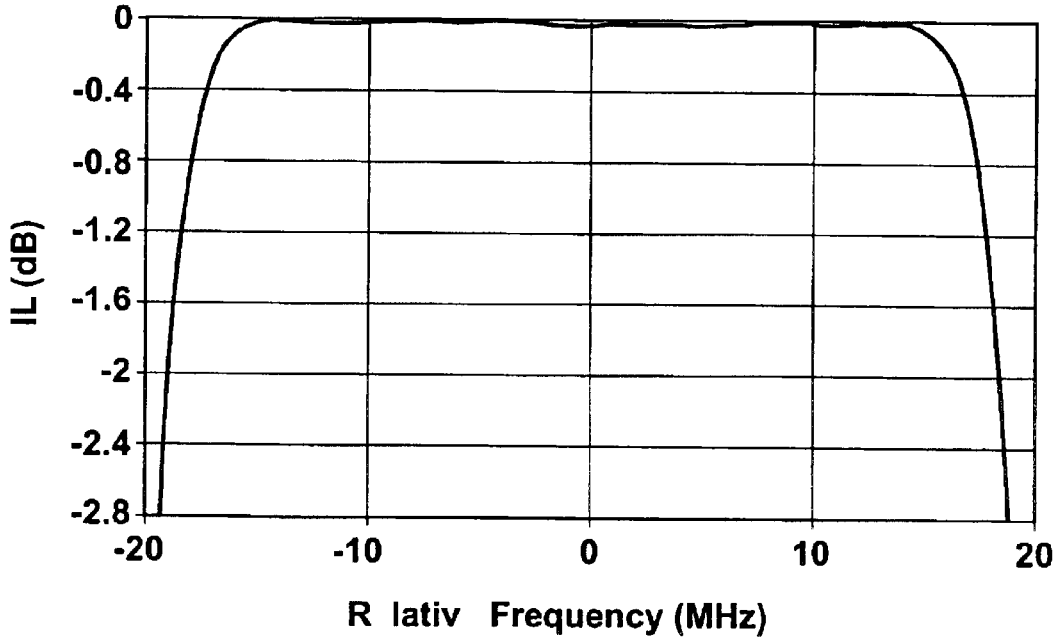

Referring now to FIGS. 11*a* and 11*b*, shown therein is the performance of the combination of an over-compensated adaptively predistorted IMUX filter with a conventional OMUX filter. FIG. 11*a* shows group delay and FIG. 11*b* shows insertion loss. Improvement can be seen in both group delay and loss variation when compared to either FIGS. 8*a* and 8*b* or FIGS. 9*a* and 9*b*. Accordingly, the over-compensated adaptive predistortion method can be used to compensate for the performance of another filter.

The adaptive predistortion method of the present invention is applicable to any filter having a plurality of poles and in particular to any type of multi-resonator microwave filter. The adaptive predistortion method may also be applied to waveguide filters, dielectric resonator filters, printed circuit filters such as microstrip filters and CPW filters as well as low temperature co-fired ceramic (LTTC) filters. The adaptive predistortion method may also be applicable to filters operating in a wide range of frequencies such as in the radio band, the microwave band and the millimeter band.

It should be noted that the example provided in Table 1 in which a coaxial resonator filter having resonators with physical dimensions to provide a Q factor of 3,000 but with coupling between the resonators to emulate a Q factor of 8,000 is shown for exemplary purposes only and is not meant to limit the invention. A higher Q factor may be emulated as long as the resulting performance is acceptable. Alternatively, resonators having physical dimensions for a Q factor lower than 3,000 such as 1,000 for example may be used as long at the resulting performance is acceptable. Furthermore, the adaptive predistortion method may be applied to a filter having resonators with a higher Q factor such as 6,000 to 12,000 or higher for example. In addition, although the adaptive predistortion method was applied to a filter having similar Q factors for each resonator, the adaptive predistortion method may also be applicable to a filter which has resonators with different Q factors. In addition, the adaptive predistortion method may involve a scenario in which one pole is moved by a first amount and the remainder of the poles are moved by a second amount.

It should further be understood that various modifications can be made to the preferred embodiments described and illustrated herein, without departing from the present invention, the scope of which is defined in the appended claims.

What is claim is:

1. A method for creating an adaptively predistorted filter, the method comprising:

a) designing a transfer function according to performance criteria specified for at least one property of the adaptively predistorted filter;

b) calculating the poles of the transfer function;

c) performing at least one iteration of adaptively predistorting the poles of the transfer function by shifting the poles, wherein at least one of the poles is shifted by a unique amount, relative to the shifting of the remaining poles, to obtain adaptively predistorted poles for creating an adaptively predistorted transfer function for achieving the performance criteria, and where each amount of shifting is a percentage of a dissipation factor that is related to the Q factor and fractional bandwidth of the filter; and, d) realizing the adaptively predistorted filter accordingly to the adaptively predistorted transfer function.

2. The method of claim 1, wherein the poles of the transfer function that are closest to the $j\omega$ axis are shifted by a smaller amount in comparison to the remainder of the poles.

3. The method of claim 1, wherein step (a) includes selecting resonators for the realization of the adaptively predistorted filter, the number of the resonators being equal to the number of poles of the transfer function, each resonator flaying a Q factor.

4. The method of claim 3, wherein each resonator has a low Q factor on the order of 1,000 to 5,000 and step (c) includes adaptively predistorting the poles for allowing the realized adaptively predistorted filter to emulate the performance of a realized filter having higher Q factor resonators.

5. The method of claim 3, wherein each resonator has a high Q factor on the order of at least 6,000 and step (c) includes adaptively predistorting the poles for improving the performance of the realized adaptively predistorted filter.

6. The method of claim 1, wherein the at least one property in step (a) is selected from the group consisting of insertion loss, insertion loss variation, group delay and return loss.

7. The method of claim 1, wherein the at least one property in step (a) includes insertion loss and group delay.

8. The method of claim 1, wherein step (c) includes obtaining a difference transfer function D(s) between the transfer function R(s) specified in step (a) and the adaptively predistorted transfer function F(s) specified in step (c) according to $D(s)=F(s)-R(s)$, step (c) further including adaptively predistorting the poles for minimizing the difference transfer function by using an optimization method.

9. The method of claim 1, wherein in step (a), the performance criteria is specified for allowing the realized adaptively predistorted filter compensate for the performance of a second filter connected to the realized adaptively predistorted fitter.

10. The method of claim 1, wherein the realized adaptively predistorted filter is a coaxial resonator filter.

11. An adaptively predistorted filter produced by:

a) designing a transfer function according to performance criteria specified for at least one property of the adaptively predistorted filter;

b) calculating the poles of the transfer function;

c) performing at least one iteration of adaptively predistorting the poles of the transfer function by shifting the poles, wherein at least one of the poles is shifted by a unique amount, relative to the shifting of the remainder of the poles, to obtain adaptively predistorted poles for creating an adaptively predistorted transfer function for achieving the performance criteria and wherein each amount of shifting is a percentage of a dissipation factor that is related to the Q factor and fractional bandwidth of the filter; and, d) realizing the adaptively predistorted filter accordingly to the adaptively predistorted transfer function.

12. The adaptively predistorted filter of claim 11, wherein the adaptively predistorted filter comprises a plurality of resonators, each resonator having a low Q factor on the order of 1,000 to 5,000 and step (c) includes adaptively predistorting the poles for allowing the adaptively predistorted filter to emulate the performance of a realized filter having higher Q factor resonators.

13. The adaptively predistorted filter of claim 11, wherein the adaptively predistorted filter comprises a plurality of resonators, each resonator having a high Q factor on the order of at least 6,000 and step (c) involves a adaptively predistorting the poles for improving the performance of the adaptive predistorted filter.

14. The adaptively predistorted filter of claim 11, wherein the performance criteria is specified for allowing the adaptively predistorted filter to compensate for the performance of a second filter connected to the adaptively predistorted filter.

15. The adaptively predistorted filter of claim 11, wherein the adaptively predistorted filter is a coaxial resonator filter.

16. An adaptively predistorted filter, the filter having an initial transfer function comprising a plurality at poles at an initial location, wherein the poles are adaptively predistorted for allowing the adaptively predistorted filter to achieve specified performance criteria, the poles being adaptively predistorted by shifting the poles away from the initial locations, at least one of the poles being shifted by a unique amount relative to the shifting of the remainder of the poles and wherein each amount of shifting is a percentage of a dissipation factor that is related to the Q factor and fractional bandwidth of the filter.

17. The adaptively predistorted filter of claim 16, wherein the adaptively predistorted filter comprises a plurality of resonators, each resonator having a low Q factor on the order of 1,000 to 5,000 and the poles are adaptively predistorted for allowing the adaptively predistorted filter to emulate the performance of a realized filter having higher Q factor resonators.

18. The adaptively predistorted filter of claim 16, wherein the adaptively predistorted filter comprises a plurality of resonators, each resonator having a high Q factor on the order of at least 6,000 and the poles are adaptively predistorted for improving the performance of the adaptively predistorted filter.

19. The adaptively predistorted filter of claim 16, wherein the performance criteria is specified for allowing the adaptively predistorted filter to compensate for the performance of a second filter connected to the adaptively predistorted filter.

20. The adaptively predistorted filter of claim 16, wherein the adaptively predistorted filter is a coaxial resonator filter.

21. A method for creating an adaptively predistorted filter, the method comprising:

a) designing a transfer function being defined by at least one polynomial according to performance criteria specified for at least one property of the adaptively predistorted filter;

b) calculating the roots of the at least one polynomial;

c) performing at least one iteration of adaptively predistorting the roots of the at least one polynomial by shifting the roots, wherein for at least one of the at least one polynomial, at least one of the roots is shifted by a unique amount, relative to the shifting of the remaining roots for the at least one of the at least one polynomial, for creating an adaptively predistorted transfer function for achieving the performance criteria and wherein each amount of shifting is a percentage of a dissipation factor that is related to the Q factor and fractional bandwidth of the filter; and, d) realizing the adaptively predistorted filter accordingly to the adaptively predistorted transfer function.

22. A method for creating an adaptively predistorted filter, the method comprising:

a) designing a transfer function for a filter having a first Q factor according to performance criteria specified for at least one property of the adaptively predistorted filter;

b) calculating the poles of the transfer function;

c) performing at least one iteration of adaptively predistorting the poles of the transfer function by shifting the poles to obtain adaptively predistorted poles for creating an adaptively predistorted transfer function having an equivalent Q factor for achieving the performance criteria; and, d) realizing the adaptively predistorted filter with a physically similar or smaller filter that is usually associated with a smaller Q factor than the first Q factor but when realized has an equivalent Q factor to the first Q factor due to the adaptive predistortion of the poles.

23. The method of claim 1, wherein the dissipation factor is $$r = \frac{1}{Q \cdot F_{BW}}$$

where Q is the Q factor of the filter and $F_{BW}$ is the fractional bandwidth of the filter.

24. The adaptively predistorted filter of claim 11, wherein the dissipation factor is $$r = \frac{1}{Q \cdot F_{BW}}$$

where Q is the Q factor of the filter and $F_{BW}$ is the fractional bandwidth of the filter.

25. The adaptively predistorted filter of claim 16, wherein the dissipation factor is $$r = \frac{1}{Q \cdot F_{BW}}$$

where Q is the Q factor of the filter and $F_{BW}$ is the fractional bandwidth of the filter.

26. The method of claim 21, wherein the dissipation factor is $$r = \frac{1}{Q \cdot F_{BW}}$$

where Q is the Q factor of filter and $F_{BW}$ is the fractional bandwidth of the filter.

* * * * *

UNITED STATES PATENT AND TRADEMARK OFFICE

CERTIFICATE OF CORRECTION

PATENT NO. : 6,882,251 B2
DATED : April 19, 2005
INVENTOR(S) : Yu et al.

It is certified that error appears in the above-identified patent and that said Letters Patent is hereby corrected as shown below:

Title page,
Item [57], ABSTRACT,
Line 1, change “a” to -- an --.
Line 3, change “(east” to -- least --.

Drawings,
Figure 5b, change “Fr qu ncy” to -- Frequency --.
Figure 8a, change “D lay” to -- Delay --.
Figure 8b, change “Relativ Frequ ncy” to -- Relative Frequency --.
Figure 10b, change “Relativ Fr qu ncy” to -- Relative Frequency --.
Figure 11a, change “D lay” to -- Delay --.
Figure 11b, change “R lativ” to -- Relative --.

Column 13,
Line 65, change “claim” to -- claimed --.

Column 14,
Line 49, insert -- to -- after the word “filter”.

Signed and Sealed this

Sixth Day of September, 2005

JON W. DUDAS
*Director of the United States Patent and Trademark Office*